United States Patent [19]

Wheeler et al.

[11] Patent Number: 4,801,342

[45] Date of Patent: Jan. 31, 1989

[54] METHOD AND APPARATUS FOR FORMING A BUTT SPLICE

[75] Inventors: Roger R. Wheeler, Roscoe; John R. Martin, Rockford, both of Ill.

[73] Assignee: Martin Automatic Inc., Rockford, Ill.

[21] Appl. No.: 153,578

[22] Filed: Jan. 29, 1988

Related U.S. Application Data

[63] Continuation of Ser. No. 907,117, Sep. 12, 1986, abandoned.

[51] Int. Cl.[4] ..... B31F 5/06; B65H 69/06

[52] U.S. Cl. ..... 156/159; 156/267; 156/304.3; 156/504; 156/505; 156/510

[58] Field of Search ..... 156/159, 258, 267, 271, 156/304.3, 304.5, 504, 505, 518, 523, 527, 510; 242/56 R, 58.1, 58.3, 58.4, 58.5

[56] References Cited

U.S. PATENT DOCUMENTS

| | | | |
|---|---|---|---|
| 3,554,842 | 1/1971 | Byrt | 156/505 |
| 3,649,416 | 3/1972 | Chapman | 156/523 |
| 3,773,598 | 11/1973 | Taeffner et al. | 156/159 |
| 3,819,454 | 6/1974 | Mason | 156/505 |
| 3,886,031 | 5/1975 | Taitel | 156/505 |
| 3,939,032 | 2/1976 | Taitel et al. | 156/159 |
| 3,957,567 | 5/1976 | Purcell et al. | 156/523 |
| 4,010,911 | 3/1977 | Heitmann | 156/505 |
| 4,157,934 | 6/1979 | Ryan et al. | 156/505 |
| 4,190,475 | 2/1980 | Marschke | 156/504 |
| 4,190,483 | 2/1980 | Ryan et al. | 156/505 |
| 4,260,444 | 4/1981 | Fowler | 156/271 |
| 4,284,463 | 8/1981 | Wright | 156/505 |
| 4,310,378 | 1/1982 | Bosco | 156/518 |
| 4,526,638 | 7/1985 | Clements | 156/159 |
| 4,629,531 | 12/1986 | Katroka | 156/504 |
| 4,645,558 | 2/1987 | Sato | 156/504 |
| 4,652,329 | 3/1987 | Focke | 156/504 |

*Primary Examiner*—Michael Wityshyn

*Attorney, Agent, or Firm*—McAndrews, Held & Malloy, Ltd.

[57] ABSTRACT

A method and apparatus is disclosed for forming a butt splice to join together a web from a new roll of material to a web which is from an expiring roll of material and which is being run, downstream from the expiring roll, under tension along a predetermined path of travel that includes a running web storage means and a press or other web handling means. To form the butt splice, the leading end of the new web is trimmed along the cutting edge of an anvil. The trimmed leading end is held against the anvil, and a piece of tape is applied to the leading end so that a portion of the tape projects downstream from that end. The portion of the expiring web, adjacent to the anvil, is then momentarily stopped, held against the anvil, and trimmed along the same cutting edge of the anvil. As the trailing end of the expiring roll is trimmed, it is simultaneously adhered to the downstream portion of the tape. This serves to join this trailing end of the expiring roll and the leading end of the new roll together. Only the portion of the expiring roll adjacent to the anvil is momentarily stopped while the expiring web is trimmed and adhered to the leading end of the new roll. The stoppage is sufficiently short that downstream portions of the expiring web can, in the interim, be withdrawn from the web storage means so that web continues to run, at full speed, to and through the press.

12 Claims, 9 Drawing Sheets

METHOD AND APPARATUS FOR FORMING A BUTT SPLICE

This application is a continuation of application Ser. No. 907,117, filed Sept. 12, 1986, now abandoned.

BACKGROUND OF THE INVENTION

The present invention relates to methods and apparatus for joining together a web from a new roll of material to a web from an expiring roll that is being fed to a printing press or other continuous web processing operation. The material may be paper, film, foil, laminate, etc.

A common method that has been used to join or splice such webs in the past is the so-called lap joint. The leading end of the new web is treated with a suitable adhesive, and at the proper time, is manually lapped over the trailing end of the expiring roll. U.S. Pat. No. 4,519,858 describes an apparatus and method for making such lap joints.

A lap joint or splice produces, however, an undesirable double thickness of material at the joint or splice. Further, certain materials, such as two-ply pressure-sensitive label stock, cannot usually be spliced in a lap joint because of restrictive operations downstream of the joint.

Another commonly used method to join new and expiring webs is the so-called butt splice. In such butt splice or joint, the leading end of the new roll is "butted-up" closely to, but is not overlapped with the trailing end of the expiring roll. A relatively thin, single-sided pieces of adhesive tape is used to join the "butted" ends together.

A butt splice or joint may be used to joint two ply material, such as pressure-sensitive label stock. With such material, pieces of adhesive tape must be used on both sides of the material so that when the plies are pulled apart, the web will remain joined.

A good quality butt joint or splice has less than a one/one thirty-second inch gap between the butted ends of the webs from the new and expiring rolls, with the ends being aligned closely. When adhesive tape is used on both sides of the web, the adhesive on one tape should not touch the adhesive on the other tape.

Traditionally, hand operations have had to be used to achieve a good quality butt splice or joint, particularly when splicing two-ply materials. The accuracy required necessitates the stopping of the web from the expiring roll for a sufficient time to make a hand splice. Such stoppage results in a significant loss of production time as each roll expires.

SUMMARY OF THE INVENTION

In principal aspect, the present invention relates to an improved method for forming an accurate butt splice or joint and to an improved apparatus suitable for expeditiously performing the method. By using the improved method, a web from a new roll of material may be easily, quickly and accurately joined to a web which is from an expiring roll of material and which continues to be run, downstream of the roll, under tension along a predetermined path of travel that includes a running web storage means, such as a web storage festoon. While a wide variety of materials may be butt spliced together, the improved method and apparatus of the present invention are especially suited for the continuous, non-stop production of die cut self-adhesive labels and heavier weight stocks where double-thickness lap splices would pose serious process problems.

The improved method and apparatus of the present invention afford a number of important commercial advantages. Minimum operator involvement is required to run the apparatus and thus accomplish a good quality butt splice. The improved methods and apparatus utilizes a zero-speed splicing concept, that is, the expiring or old web is brought to a stop during the actual splicing for the new web to the expiring web. Nevertheless, due to the speed at which the butt splice may be formed and the use of the running web storage means, the press or web processing operation can continue at full speed as material is drawn from the running web storage means during the splicing operation. Thus, the use of the improved method and apparatus permits significantly increased production to be achieved in terms of the overall speed of the press. Furthermore, having to stop the press in the past to change rolls has resulted in a lost of material. The use of the improved method and apparatus of the present invention should more than pay for the apparatus in the first year in material savings alone.

Accordingly, it is an object of the present invention to provide an improved method for forming a good quality butt splice by holding a portion of the web from the new roll against an anvil that includes a cutting edge disposed at an angle to the path of travel of the expiring web running past the anvil. The portion of the new web is then trimmed or cut along the cutting edge of the anvil so that the trimmed edge of the downstream, leading end of the new web is aligned with and congruent to the anvil's cutting edge. Single sided adhesive tape is then applied to the leading end so that a portion of the tape extends downstream beyond the anvil's cutting edge and the trimmed end of the new web. The web from the expiring roll is then momentarily stopped, a portion of that web is held against the anvil; that portion of the expiring web is trimmed or cut along the anvil's cutting edge, and the trailing end of the expiring web is pressed against and adhered to downstream portion of the tape so that the leading end of the new web and trailing end of the expiring web are secured or joined together by the tape. The joined new and expiring webs are then permitted to run again through the running web storage means and to the press or other web processing operation.

Another object of the present invention is to provide an improved method, as described, where the portion of the expiring web is trimmed and the trailing end is adhered to downstream portion of the tape substantially simultaneously. A related object is to provide an improved method, as described, where the leading end of the new web and the downstream portion of the tape are supported during the time the portion of the expiring web is trimmed and its trailing end is pressed against and adhered to the downstream portion of the tape.

Still another object of the present invention is to provide an improved method, as described, where a second piece of adhesive tape may be applied to the other sides of the leading end of new web and the trailing end of the expiring web after the joined webs have begun to run again.

A further object of the present invention is to provide an improved apparatus that is suitable for performing the improved method as described and that can expeditiously form a good quality butt splice by trimming or cutting both the new and expiring webs along the same anvil cutting edge and by trimming the expiring web while simultaneously adhering the trimmed trailing edge of the expiring web to adhesive tape projecting downstream from the leading end of the new web. A related object of the present invention is to provide an improved apparatus as described, where the web need only be momentarily stopped, adjacent to the apparatus, to effect the formation of a good quality butt splice and so that with the use of a running web storage means, the remainder of the web can continue running uninterruptedly through the press or other web processing operation during the entire splicing operation.

These and still other objects, advantages and aspects of the present invention are more fully set forth in the detailed description of the preferred embodiment of the present invention which follows.

DESCRIPTION OF THE DRAWINGS

In the detailed description of the invention which follows, reference will be made to the accompanying drawings comprised of the following figures.

DETAILED DESCRIPTION OF THE PREFERRED EMBODIMENT

Figure 1:
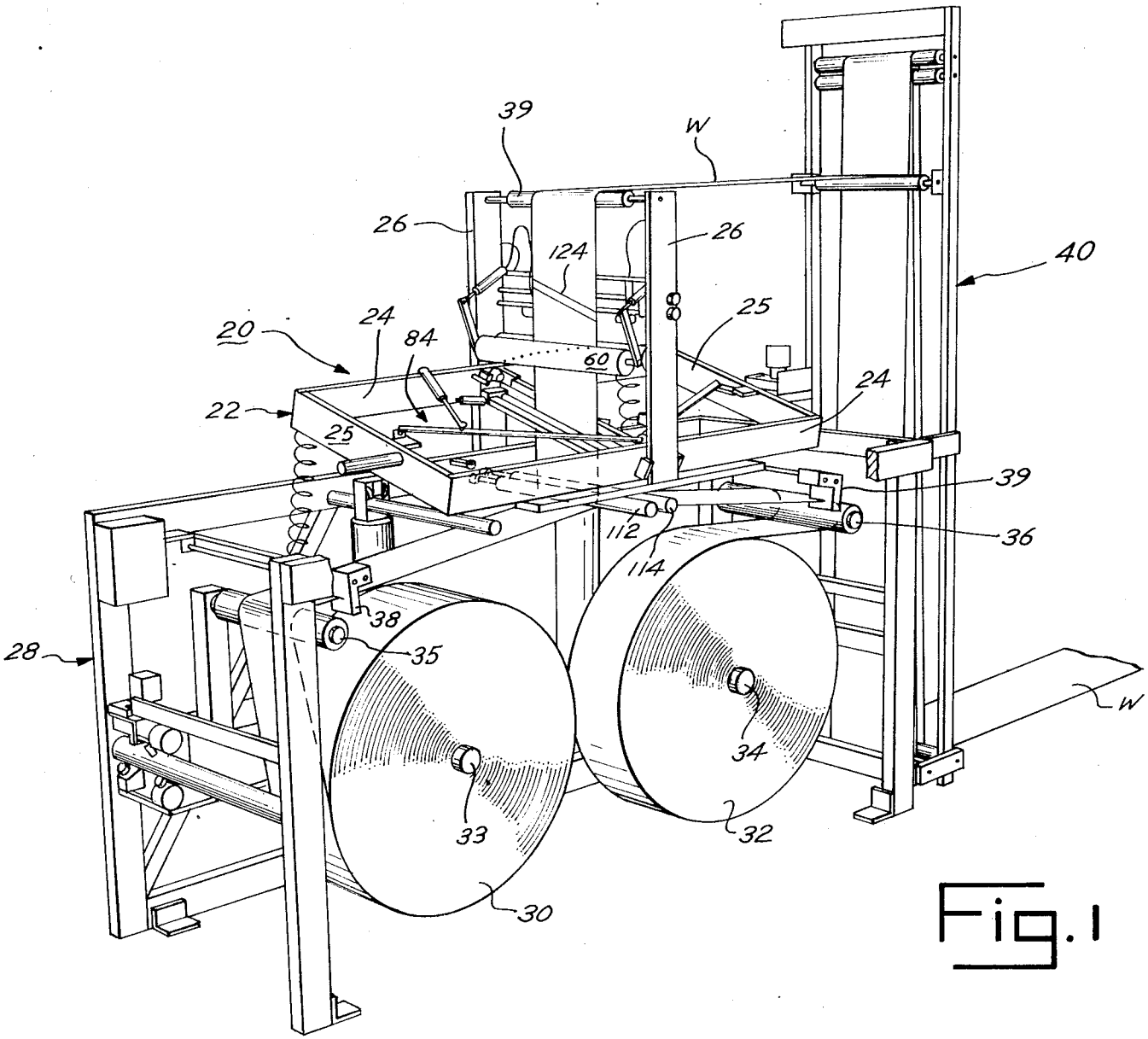
FIG. 1 is a front perspective view of a preferred embodiment of apparatus for performing the improved method of the present invention which apparatus is shown mounted on a stand for holding the rolls of web material and associated with a web storage festoon.
Figure 2:
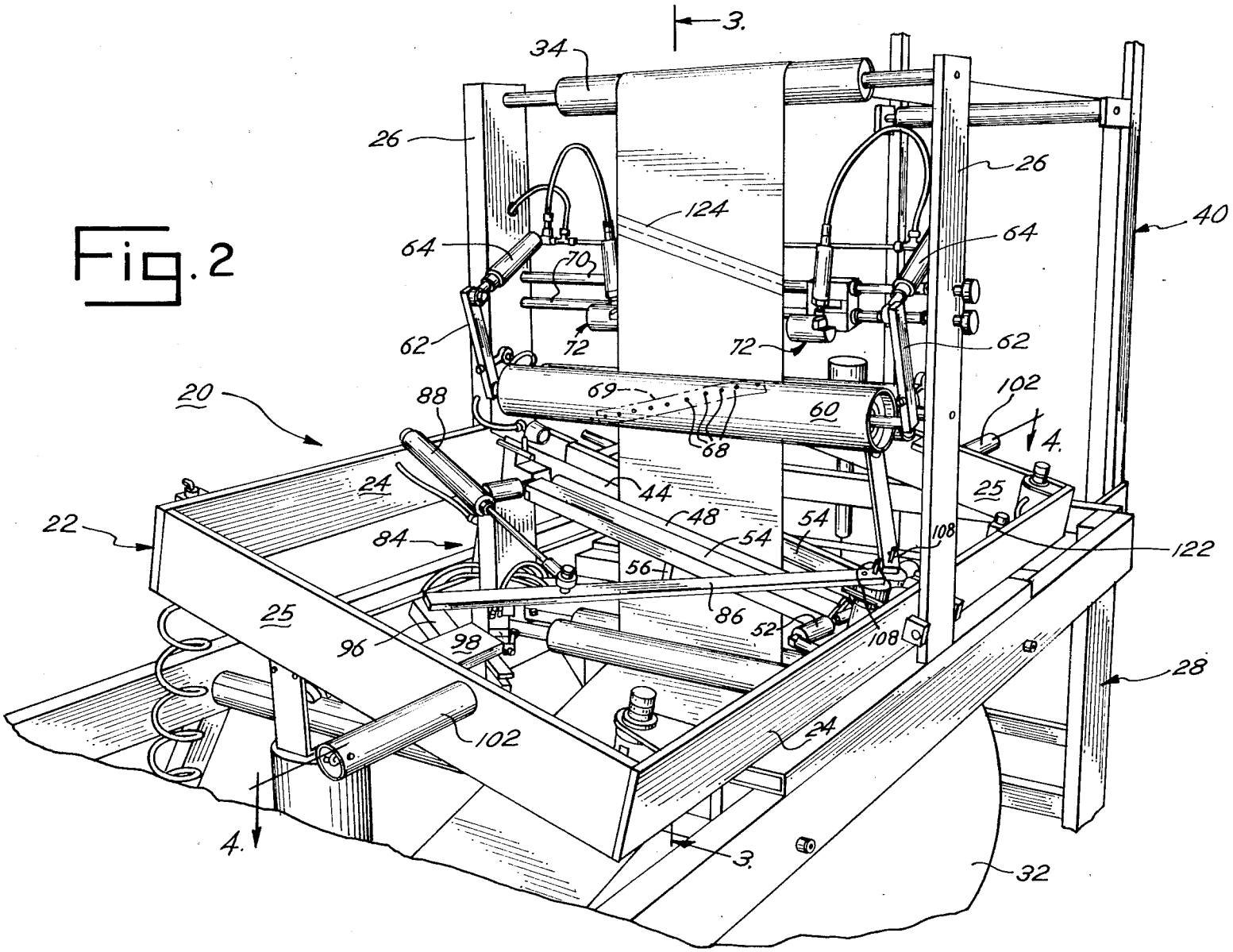
FIG. 2 is an enlarged, front perspective of the apparatus of FIG. 1.

Referring now to FIGS. 1 and 2, the preferred embodiment of the improved apparatus of the present invention is generally designated at 20. This apparatus includes an open, generally rectangular frame 22 comprised of two side members 24 and two end members 25 that are secured together at their ends. A vertical upright member 26 is secured, at its lower end, to each of the side members 24, midway between the end members 25. The upright members 26 project upwardly from the plane of the frame 22.

A stand 28 supports the frame 22. The frame 22 is disposed on the support stand 28 at an angle, preferably 15 degrees, with respect to the horizontal so that one side member 24 is higher than the other. Two web rolls 30 and 32 of material are also mounted on the stand 28 on horizontally disposed spindles 33 and 34, respectively. U.S. patent application, Ser. No. 193,290, filed May 5, 1988 describes a stand that may be used as the stand 28. The frame 22 is supported directly above the rolls.

The web rolls 30 and 32 may contain a web of a variety of materials such as paper, film, foil, laminate, etc., wound about a central core or spool. However, the apparatus 20 has particular utility with regard to the splicing of two-ply, pressure-sensitive label stock.

Idler rollers 35 and 36 and conventional mechanisms 37 and 38 for aligning and adjusting the position of a web are associated with the web rolls 30 and 32, respectively, and are also mounted on the stand 28. The leading ends of both web rolls 30 and 32 may be fed around their associated rollers 35 and 36, through their associated mechanisms 37 and 38 and to the apparatus 20.

Normally the web from only one of the web rolls 30 and 32 is running. This running web (indicated generally by the letter "W") passes, under tension, vertically through the apparatus 20 and except during the splicing operation, does not engage the apparatus. After passing through the apparatus, the running web W turns about an idler roll 39 that is mounted at and between the upper ends of the members 26. It then passes to and through a conventional festoon assembly shown generally at 40. This festoon assembly may be made in accordance with the teaching of U.S. Pat. Nos. 3,659,767 and 4,519,858. In essence, the assembly 40 functions as an accumulator for the running web. It maintains a constant tension on the running web downstream of the assembly 40 and permits the web to keep running, downstream from the assembly, for awhile after the web has been stopped upstream from it. When the running web W exits from the assembly 40, it proceeds to a printing press or other such web handling means, not shown.

As the web roll that is feeding web to the press expires, the apparatus 20 may be operated to expeditiously join, in a good quality butt splice, the leading end of the new web roll to the trailing end of the expiring web roll so that web can uninterruptedly and continuously be fed to the press. The web from the expiring web roll momentarily stops while the splicing operation takes place. During this brief stoppage, web continues, however, to feed from the festoon assembly 40 to the press so that at all times, web is running, under tension, to and through the press. Thus, the splicing operation does not cause any loss of material due to press stoppage nor any loss of press production time.

As best seen in FIGS. 3 and 6–9, an anvil 44 extends from one side of the frame 22 to the other and is secured, at its ends, to the side members 24 midway between their ends. The plane of the anvil is vertical and is perpendicular to the plane of the frame. Its leading or downstream "edge" (in terms of the web flow) defines a cutting edge 46 which is wider than the width of the web. The cutting edge 46 is used to trim or cut the expiring and new webs as explained hereinafter.

The anvil 44 is disposed so that it is adjacent to the path of travel of the running web as it passes through the apparatus 20. The sides of the anvil 44, upstream from the cutting edge 46, are substantially parallel to this path of travel and to each other.

A pivotable nip roll 48 is positioned adjacent to each side of the anvil 44. Each nip roll is adapted to selectively be pressed against the side of the anvil so that a web may be held against the anvil during the splicing operation. The structure and function of the two nip rolls 48 are identical, and thus the same reference numerals are used in describing them.

As best illustrated in FIGS. 3–11, each of the nip rolls 48 extends substantially along the entire adjacent side of the anvil 44. The length of the nip roll is greater than the width of the web. Its ends are journaled in fixed bearings 50 so that each of the nip rolls 48 may be pivoted between a first position, such as shown in the left hand side of FIG. 3, where the nip roll is spaced from the adjacent side of the anvil 44 and a second position, such as shown in the right hand side of FIG. 3, where the nip roll presses against the side of the anvil 44. When a nip roll 48 is in its first position, the web may freely run between it and the adjacent side of the anvil. When a nip roll is in its second position, the nip roll serves to hold or clamp the web between it and the adjacent side of the anvil.

Two pneumatic, double acting power cylinders 52 are associated with each nip roll 48, with one power cylinder 52 being connected with each end of the nip roll. More specifically and as best seen in FIGS. 6–9, the rod end of each power cylinder 52 is pivotly connected with a member 55 which, in turn, has one end pivotly connected with the end of the nip roll 48. Each of the other ends of the power cylinders 52 is pivotly connected with a bracket 53 that is mounted on the side members 24. The two power cylinders, connected to the opposite ends of a nip roll 48, can move that nip roll between its first and second positions and urge the nip roll tightly against the adjacent side of the anvil 44 when in its second position.

Two backup bars 54 are mounted, adjacent to their ends, to the other ends of the members 55 for pivotal movement about an axis parallel to the longitudinal axes of the anvil 44 and the nip rolls 48. Like the nip rolls, the backup bars 54 are identical in structure and function, and the same reference numerals are used in describing them.

Figure 7:
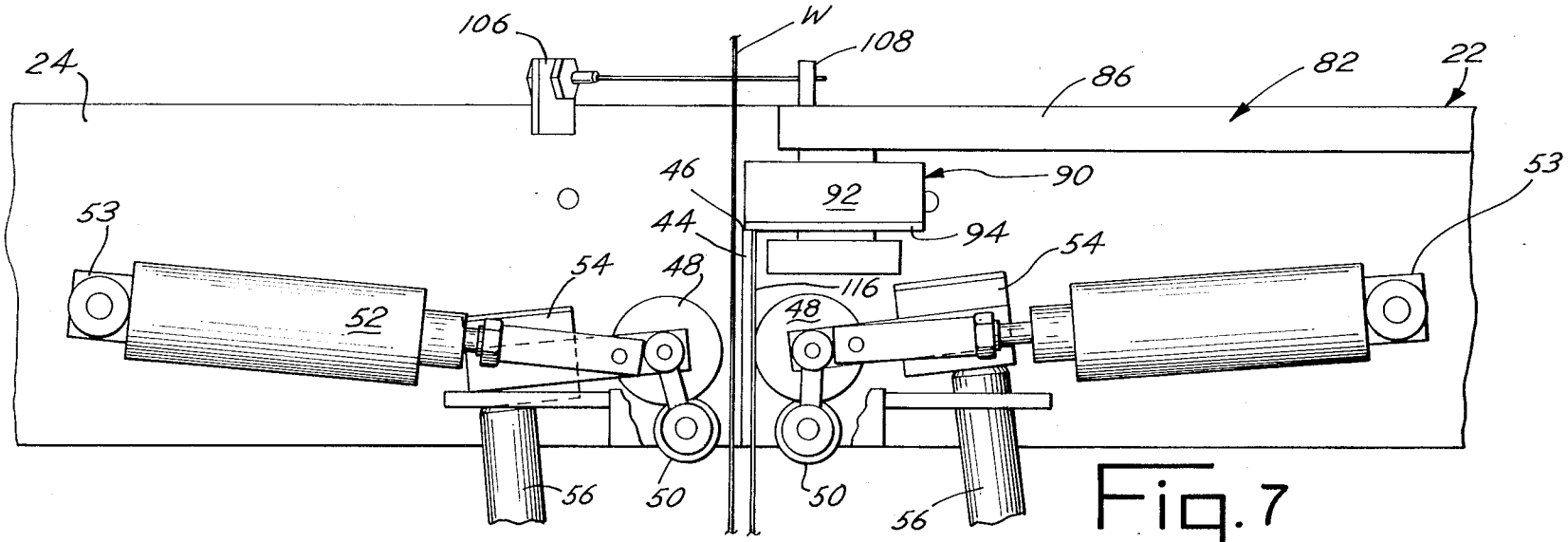

Each of the backup bars 54 is adapted to be pivoted between: a first position, such as shown in the left hand side of FIG. 7, where it is spaced from the adjacent side of the anvil 44 and where it rests on and is supported by roll pins 57 mounted on the side members 24; a second position, such as shown on the right hand side of FIG. 7; and a third position. When in its third position, the backup bar 54 abuts the adjacent side of the anvil 44 and the cutting edge 46 such as shown in the right hand side of FIG. 8. A portion of the backup bar extends beyond or downstream from the cutting edge 46 so as to provide a backup or support for a piece of adhesive tape as hereinafter described. When the backup bar 54 is in its first position, the web may freely run between it and the adjacent side of the anvil. Each backup bar 54 has a handle 56 that may be used by the operator to move the backup bar between its positions.

Figure 3:
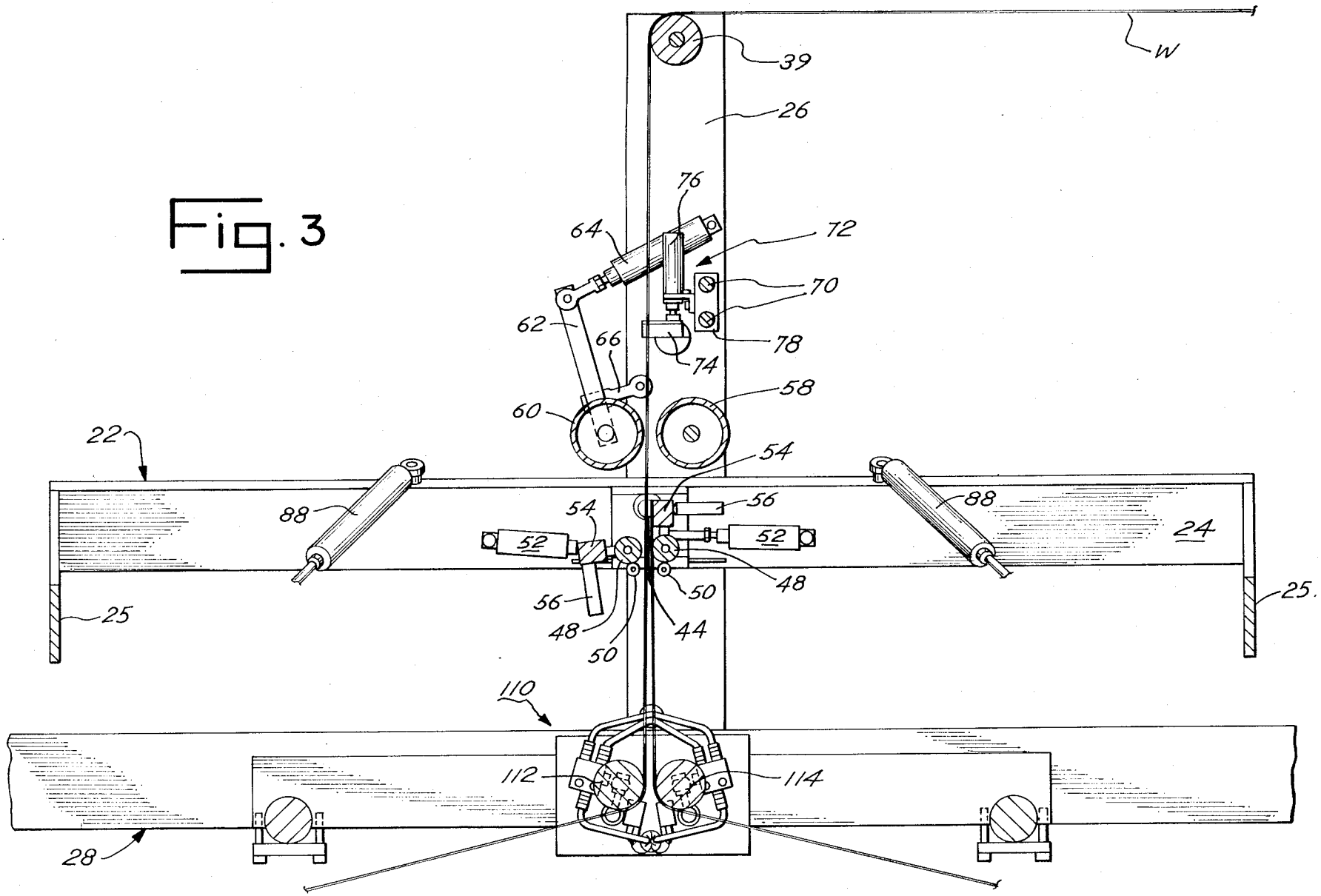
FIG. 3 is a partial cross-sectional view taken along the line 3—3 in FIG. 2.
Figure 10:
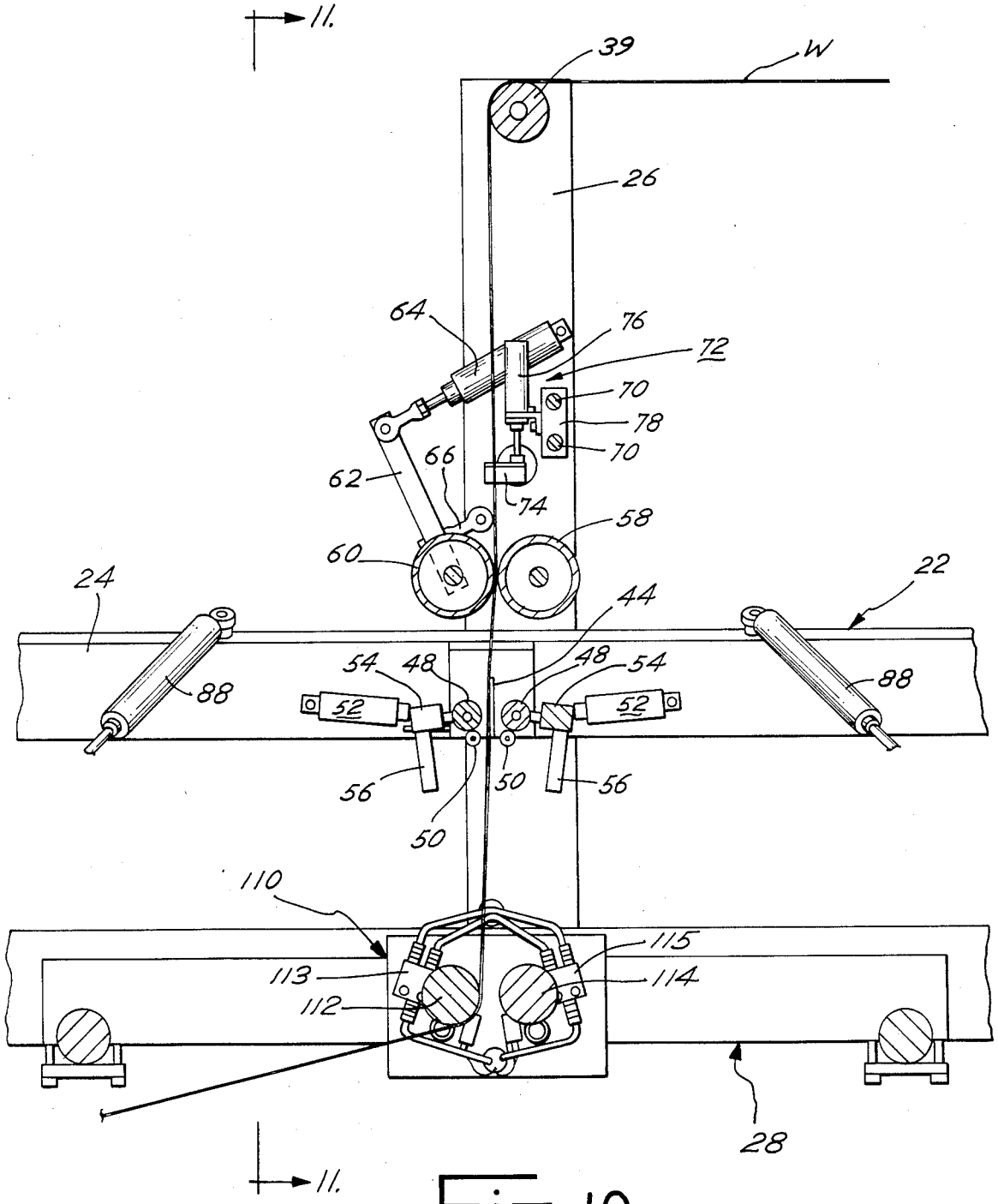
FIG. 10 is a cross-sectional view similar to FIG. 3 and illustrating the application of the second piece of tape to the butt splice as the butt splice moves away from the anvil.

Referring now to FIGS. 3 and 10, a pair of tubular vacuum rolls 58 and 60 are mounted for rotation between the upright numbers 26. Vacuum roll 58 is mounted for rotation, about a fixed central longitudinal axis. Vacuum roll 60 is, however, movable between a first position, such as shown in FIG. 3, where the periphery of the vacuum roll is spaced from the web as it passes through the apparatus 22 and a second position, such as shown in FIG. 10, where the periphery of the vacuum roll 60 is tightly pressed against the periphery of the vacuum roll 58.

Each end of the vacuum roll 60 is supported by identical assemblies, and only one will be described in detail. More specifically, each end of the vacuum roll 60 is supported, for rotational movement about its central longitudinal axis, at one end of a mounting bar 62. The other end of each of the mounting bars 62 is pivotally connected with the rod end of a pneumatic double acting power cylinder 64. The other end of each of the power cylinders 64 is pivotly connected with its adjacent vertical member 26. An arm 66 is pivotally connected, at one end, with the adjacent member 26 and at its other end, with the member 62 between its ends. Actuation of the two power cylinders 64 causes the members 62 to pivot about the other ends of the arms 66 and thus moves the vacuum roll 60 between its first and second positions.

Each of the vacuum rolls 58 and 60 have a plurality of small holes in its periphery, as indicated at 68 in FIG. 2. These holes 68 are arranged in a spiral pattern from one end of each vacuum roller to the other. The interiors of the vacuum rolls are connected with a source of vacuum by conventional means, not shown. A piece of single sided adhesive tape, shown in phantom line at 69 in FIG. 2, may be laid over the holes 68, with its adhesive side facing radially outwardly, and held on and about the periphery of one of the vacuum rolls by the vacuum prior to and during the splicing operation.

As best illustrated in FIGS. 2–3, 10 and 11, a pair of metal bars 70 extend between the upright members 26 above or downstream from the vacuum rolls 58 and 60. These bars support two web-side trimming assemblies 72, one adjacent to each side edge of the running web W. The bars 70 are positioned to the side of the path of the travel of the web W and do not interfere with the web as it passes through the apparatus 20.

Each of the two side-web trim assemblies 72 are structurally and functionally the same, and for that reason, the same reference numerals are used in describing them. Each includes a trimmer head 74 that carries a cutting blade adapted to trim any material, like tape, that extends beyond the side edge of the running web W. Each of the trimmer heads 74 is mounted on the rod end of a pneumatic single acting, spring return power cylinder 76. They may be moved between a first position where the trimmer heads are spaced from the running web W and its path of travel and a second position where the trimmer heads are adjacent to the side edges of the web as it runs through the apparatus 20. Actuation of the power cylinders 76 causes the trimmer heads 74 to be moved between their first and second positions.

Two bracket block assemblies 78 are slidably mounted on the bars 70. Each serves to mount one of the power cylinders 76 on the bars 70.

As noted above, the idler roll 39 is mounted for rotation between the upper ends of the members 26. The path of travel of the web W changes direction as the web passes about the roll 39 from a vertical path, assumed as it passes through the apparatus 20, to a horizontal path as it enters the festoon assembly 40.

Figure 4:
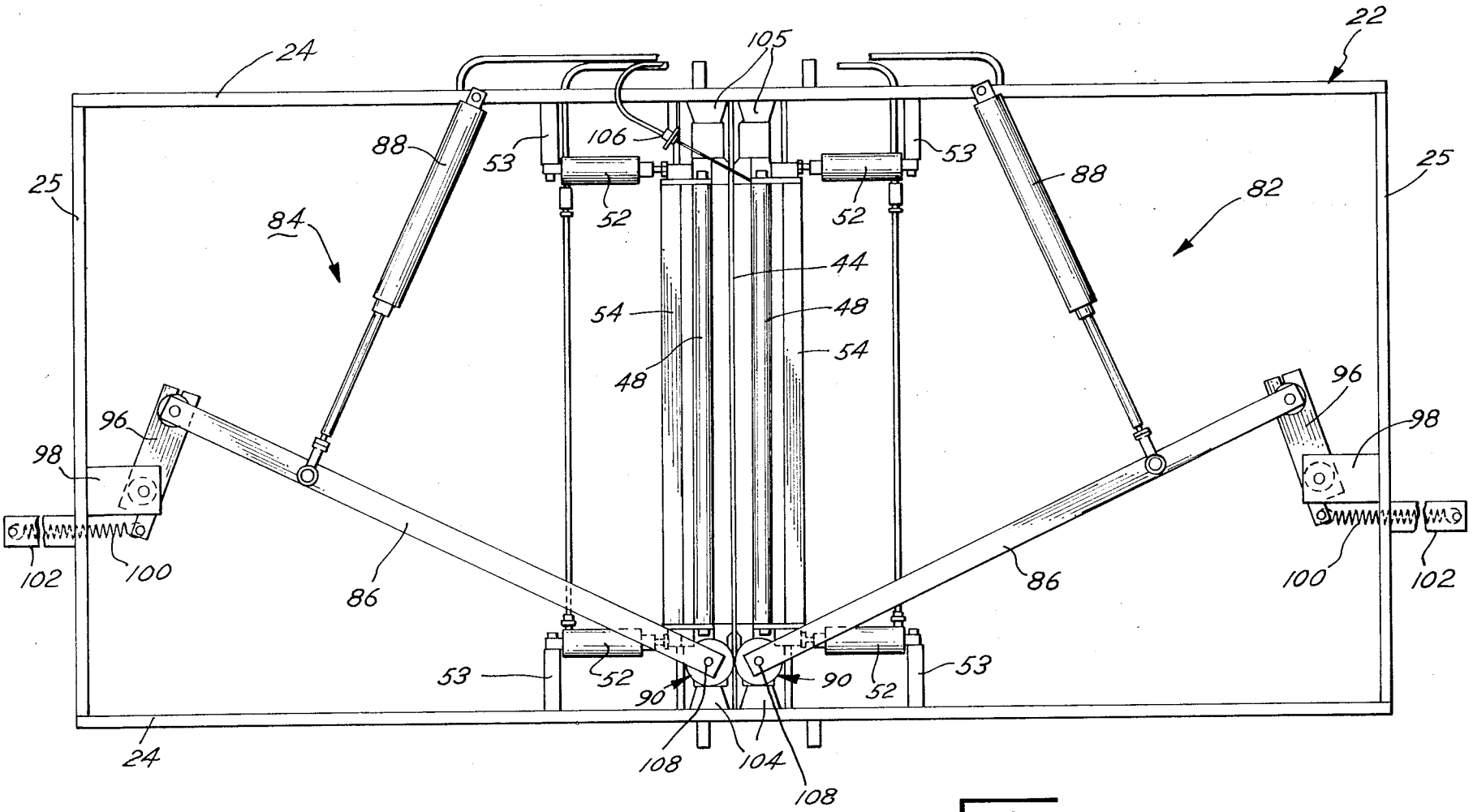
FIG. 4 is a cross-sectional view taken along the line 4—4 in FIG. 2.
Figure 5:
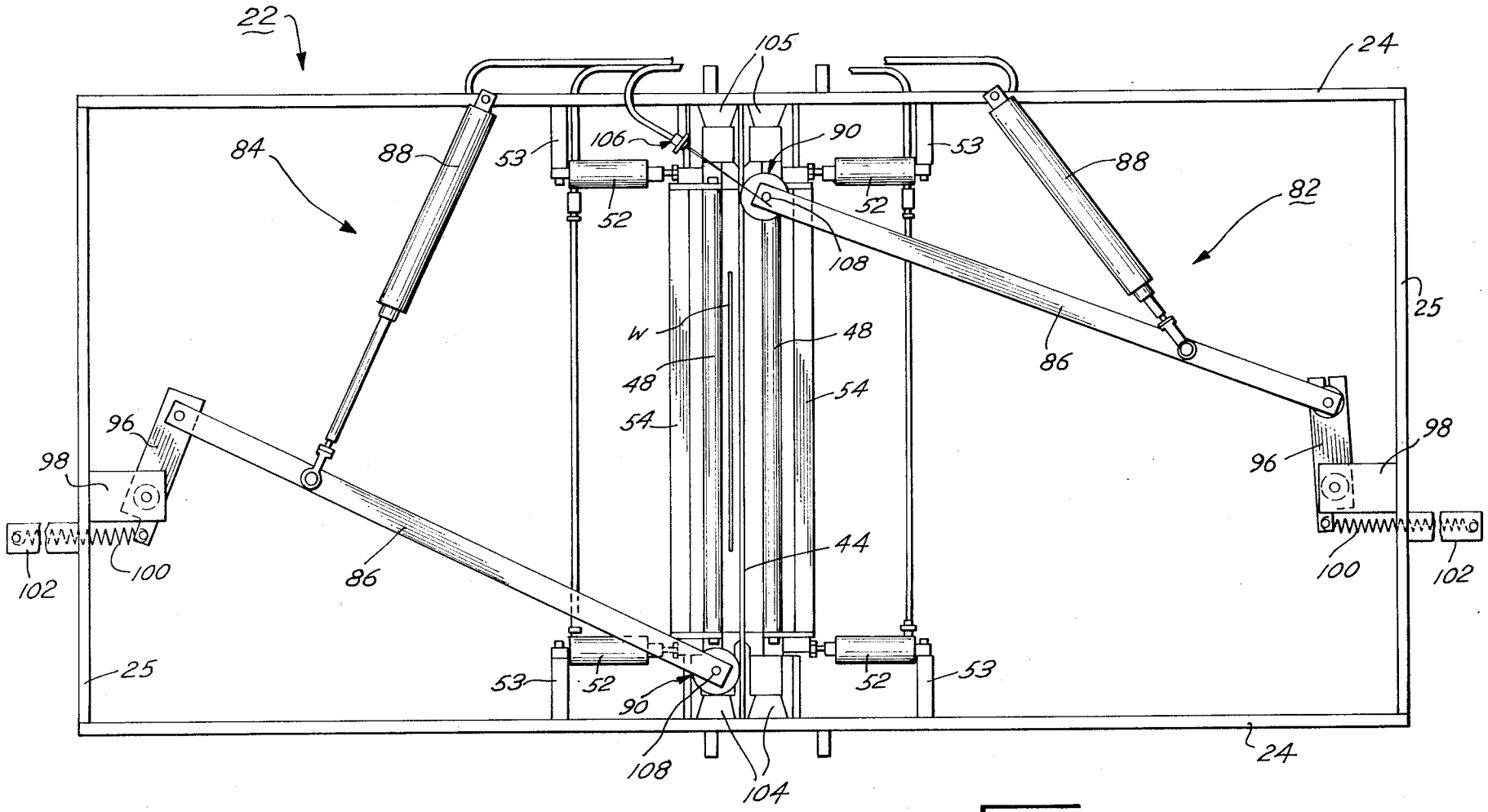
FIG. 5 is a cross-sectional view similar to that in FIG. 4 wherein the right hand arm mounted cutter is shown in its other position.
Figure 6:
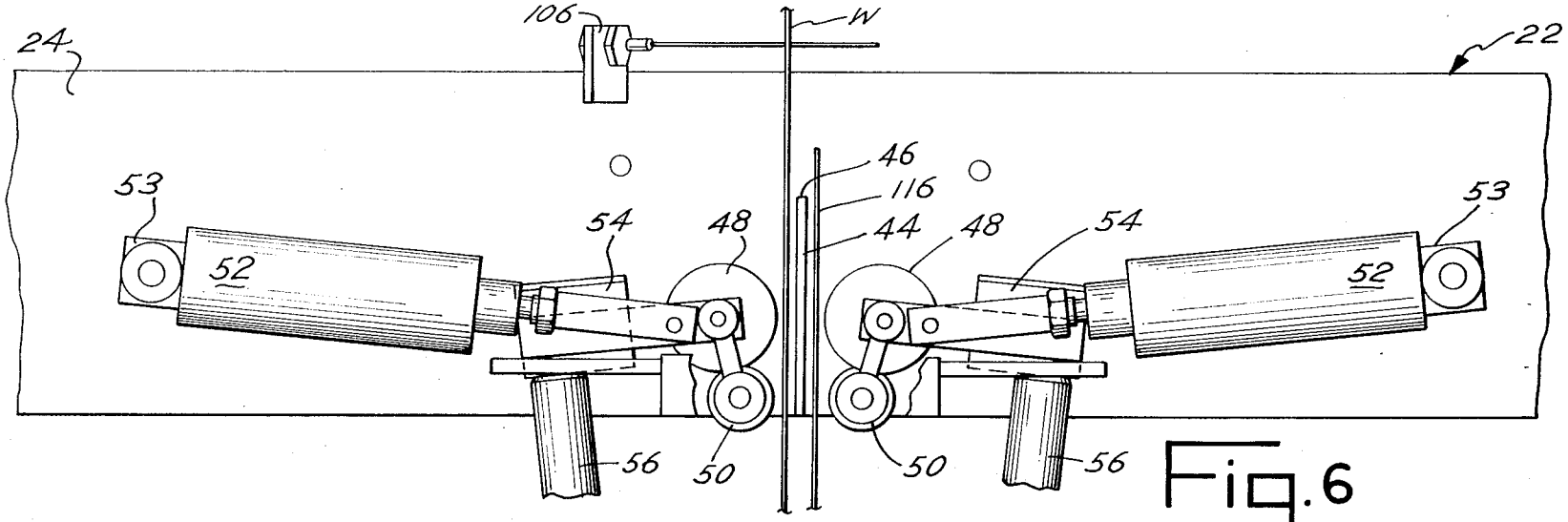
FIGS. 6–9 are similar, vertical cross-sectional views, taken transverse to the axes of the cutting edge of the anvil of the apparatus of FIG. 1, and illustrating various positions of the circular roller knives, and the web back-up bars during the formation of the butt splice.

Referring now to FIGS. 4 and 5, splice wheel arm assemblies 82 and 84 are shown mounted on the frame 22. During the splicing operation, one of these assemblies 82 or 84 is used to trim or cut the leading edge end of the web from the new roll. The other assembly 84 or 82 is then used to trim or cut the web from the expiring or old roll while simultaneously pressing the trimmed, trailing end of the expiring roll against adhesive tape previously applied to the leading end of the web from the new roll. Which of the assemblies 82 and 84 does which function in any particular splicing operation depends on the location of the new and expiring web roll on the support stand 28. In other words, the splice wheel arm assembly located immediately above the new web roll will be the assembly used to trim or cut the leading end of the new roll. The other assembly, that is, the one immediately above the expiring web roll, will be then used with the web from the expiring web roll.

The two assemblies 82 and 84 are identical in structure, and accordingly, the same reference numerals are used in describing them. Each includes a splice wheel arm 86. The rod end of a pneumatic single acting power cylinder 88 is pivotally connected with the arm 86 intermediate its ends. The other end of the power cylinder 88 is pivotally connected with the upper one (as shown in FIGS. 4 and 5) of the side members 24. The point of connection between the power cylinder 88 and the side member 24 is approximately one third of the way between the anvil 44 and the adjacent end member 25.

A knife wheel assembly 90 is mounted on one end of the arm 86 and is disposed next to the adjacent side of the anvil 44. The assembly 90 includes a roller 92 that is disposed, in relation to the anvil 44, so that its lower or upstream edge is positioned just above or downstream from the cutting edge 46 of the anvil. The roller 92 rotates about an axis parallel to the side of the anvil 44.

Figure 9:
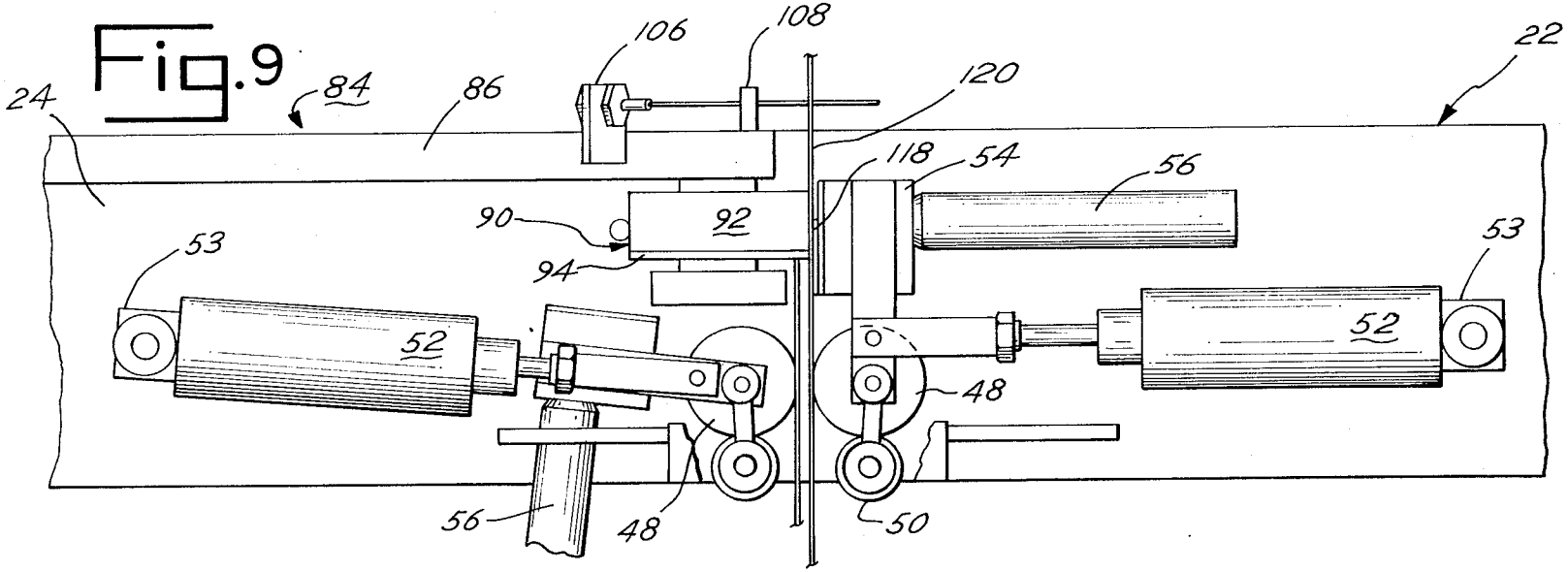

The bottom or upstream side of the roller 92 constitutes a rotary, round knife or cutting edge, indicated at 94 in FIGS. 7 and 9. This rotary edge 94 is aligned with the cutting edge 46. The plane of the rotary edge 94 is perpendicular to the plane of the side of the anvil 44. The rotary edge 94 rotates with the roller 92 and trims or cuts the web, along the cutting edge 46, when a web is adjacent to its side of the anvil and when the assembly 90 is moved along the cutting edge 46.

The assembly 90 also includes a depending cylindrical bearing member 95 that is carried by the roller 92 below the lower edge of the roller 92. The bearing member 95 rotates about the same axis as the roller 92. The diameter of its outer bearing surface is such that when the roller 92 is positioned as shown in the right hand side of FIG. 7, the bearing surface is in contact with the adjacent side of the anvil 44. The bearing surface thus holds the web against the side of the anvil while the web is being trimmed. The bearing member 95 also serves to guide the assembly 90 along the anvil 44 during the trimming of the new web.

The other end of the arm 86 is connected, for limited pivotal movement, with a bearing block 96. A pivot block 98 is secured to the adjacent end member 25 of the frame 22 and is pivotally connected with the bearing block 96, intermediate its ends, so that the bearing block 96 may pivot about this point of connection. The other end of the bearing block 96 is attached, by a pin, to one end of a coil extension spring 100. The other end of the spring 100 is received within one end of a hollow spring tube 102 and is connected to the other, projecting end of the tube. The spring tube 102 is mounted in a hole in the member 25. The spring 100 exerts a force on the bearing block 96 and tens to bias the other end of the bearing block 96 away from the adjacent end member 25 which, in turn, biases the knife wheel assembly 90 toward the anvil 44.

Actuation of the power cylinder 88 of the assembly 82 causes its knife wheel assembly 90 to move from a first position, as shown in FIG. 4, where the assembly 90 was adjacent to the lower side member 26 to a second positon, as shown in FIG. 5, where the assembly 90 is adjacent to the upper side member 26. Such actuation of the cylinder 88 causes relatively rapid movement of the assembly 90. The assembly 82 may be returned to its first position, as shown in FIG. 4, from its second position, as shown in FIG. 5, by the operator manually moving the assembly. The assembly 84 may be moved between its first and second positions in a similar fashion.

When the assemblies 82 and 84 are in their first positions, as shown in FIG. 4, the rollers 92 abut and rest against stops 104 that are secured to the inside of the adjacent side member 24. Similar stops 105 are secured to the inside of the other side member 24, and the rollers 92 abut against them when the assemblies are in their second positions.

A conventional whisker valve 106 is mounted on the inside of the upper, side member 24 as illustrated in FIGS. 4 and 5. In each of the assemblies 82 and 84, a vertically disposed pin 108 is mounted on the one end of arm 86 (that is, the end that carries the knife wheel assembly 90) and projects upwardly above the arm 86 and the assembly 90. The "whisker" portion of the valve 106 extends across the path of movement of the assembly 90 and is acutated by the pin 108 when an assembly 82 and 84 is moved to its second position.

Figure 11:
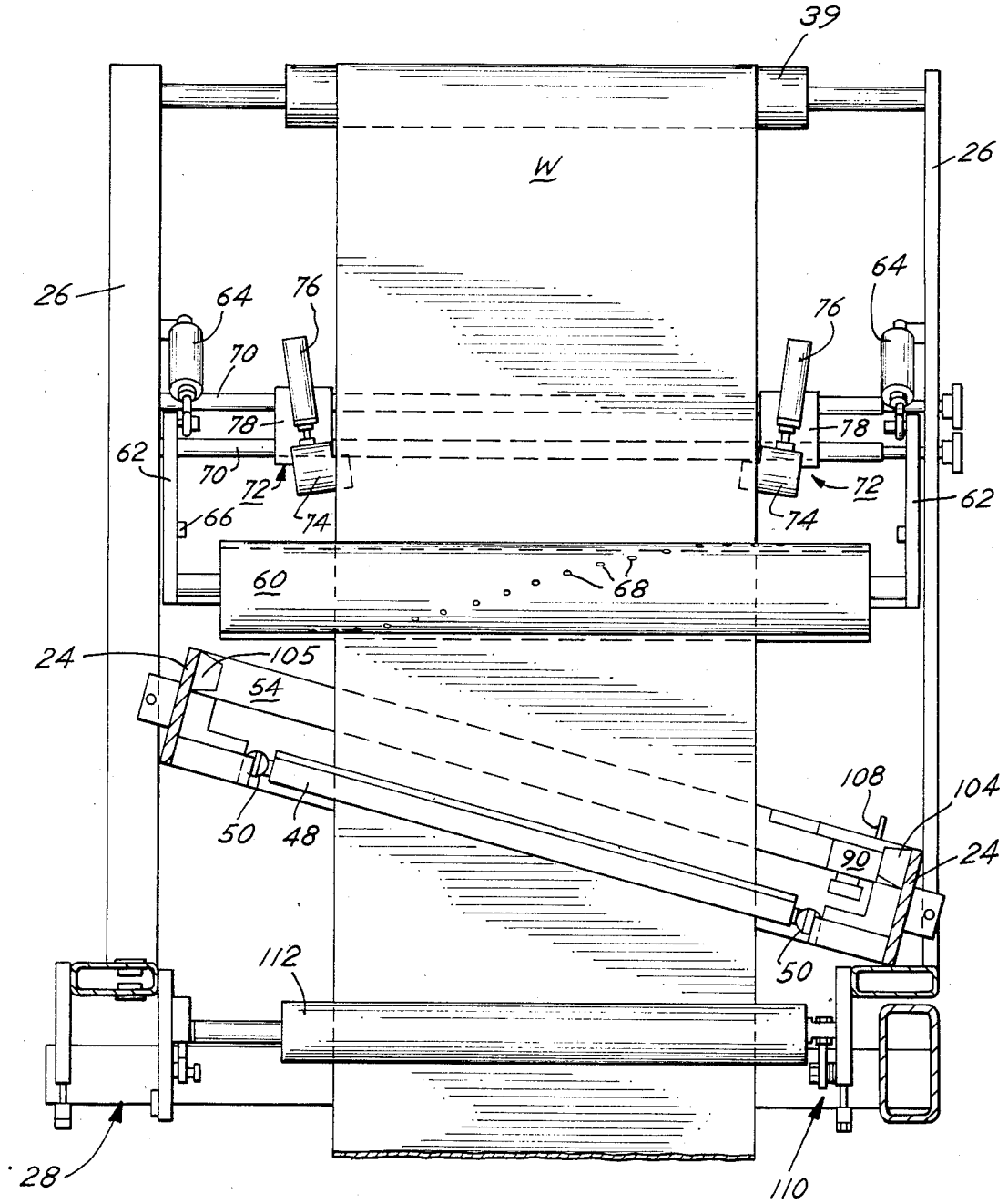
FIG. 11 is a partial front elevational view taken along the line 11—11 in FIG. 10.

As best shown in FIGS. 1, 10 and 11, a conventional drop roll assembly 110 is mounted on the stand 28 immediately below or upstream from the anvil 44. The assembly 110 includes a pair of drop roll 112 and 114 that are, in turn, connected with their associated, conventional valves 113 and 115, respectively. These drop rolls 112 and 114 serve to direct the web coming from the web rolls 30 and 32 respectively, to a vertical path of travel that extends past the anvil 44 and to the idler roll 39.

The improved method of the present invention may be performed using the apparatus 20 as follows: When the press is operating, web is being fed from one of the web rolls 30 or 32, for example, web roll 30. This web runs through the drop roll assembly 110, through the apparatus 22, over the idler roll 39, through the festoon assembly 40, and to and through the press or other web handling device downstream from the assembly 40. While the web thus running, the normal practice is to mount a new, full web roll, for example web roll 32, on the spindle 34 so that the new web roll 32 will be ready when the "running" roll 30 expires. In anticipation of the actual splicing operation, the leading end of the new web roll 32 is manually threaded about the idler roll 36, through the mechanism 38 and about the drop roll 114. This leading end is then brought adjacent to the right side of the anvil 44 as shown in FIGS. 6–9. In this regard, it should be noted that the running web from the web roll 30 is then moving past the left side of the anvil as shown in FIGS. 6–9.

The leading end of the new web, indicated by the reference numeral 116 in FIGS. 6–9, is then trimmed or cut by the knife wheel assembly 90 of the splice wheel arm assembly 82. Before the end 116 is trimmed, the assembly 82 is in its second position, that is, the position shown in FIG. 7 where the assembly 82 is disposed adjacent to the upper, side wall 24. To trim the leading end 116, the assembly 82 is manually moved from its second position to its first position by the operator. Normally the operator stands adjacent to the lower, side member 24, as seen in FIGS. 4 and 5, grasps the arm 86 and pulls the assembly 82 toward him.

As the assembly 82 moves away from the stop 105, the whisker valve 106 is returned to its normal position. This actuates the power cylinders 52 connected with nip roll 48 associated with the assembly 82. The actuation of these power cylinders 52 cause the nip roll 48 to be pivoted counterclockwise, as seen in FIGS. 6–9, about their bearings 50 and to clamp the leading end 116 against the adjacent side of the anvil 44. As the assembly 82 continues to move to its first position and as best illustrated in FIG. 7, its rotary edge 94 trims or cuts the leading end 116 along the cutting edge 46. Thus the leading edge of that end 116 is aligned and made congruent with or conforming to the cutting edge 46 of the anvil 44.

Figure 8:
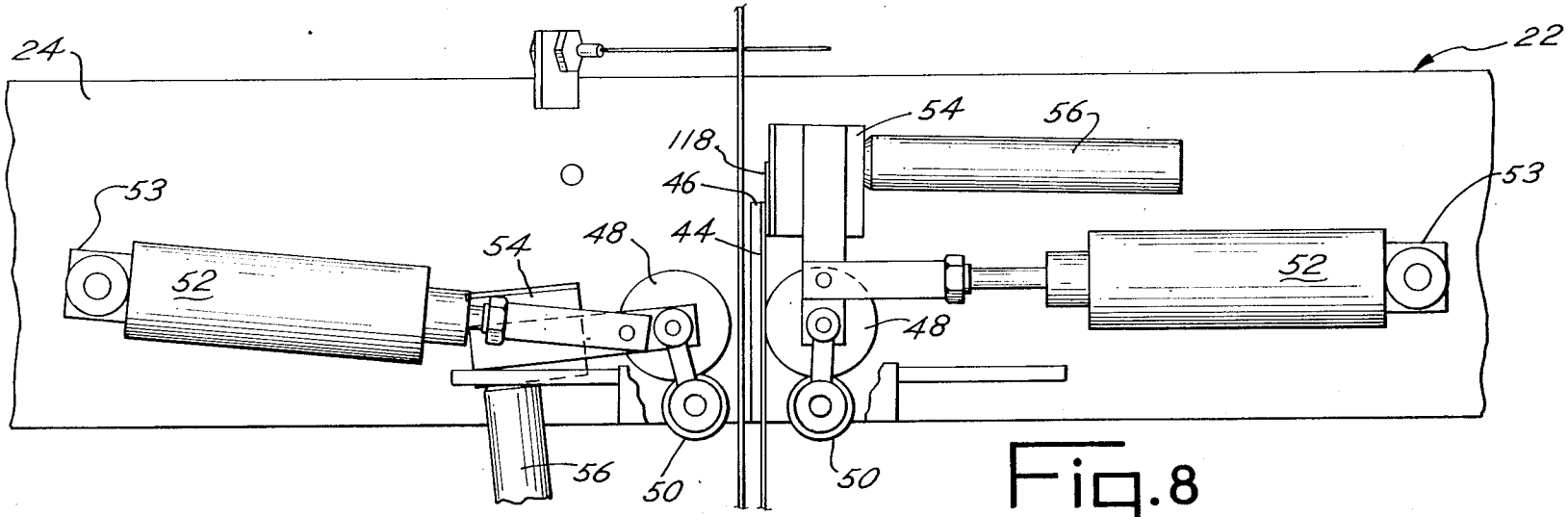

After the leading end 116 has been trimmed, the operator then puts a piece of single sided adhesive tape 118 on the leading edge of the end 116. The tape is placed so that it extends from one side of the leading end 116 to the other, so that approximately one-half of the tape 118 projects beyond or downstream from the cutting edge 46 and the leading edge of the end 116, and so that the adhesive surface faces the anvil and the running web. Next the associated backup bar 54 is moved to its third position, as shown in FIG. 8, wherein the backup bar, in part, abuts the adjacent side of the anvil and supports the tape 118. The backup bar is pivoted to its third position by the operator grasping the handle 56 and manually moving the bar.

Additionally, the operator also places a piece of single sided adhesive tape 69 on the vacuum roll 60. The tape 69 overlies the holes 68, and its length is such that when applied to the web, it will extend from one side of the web to the other. As noted before, the tape 69 is placed on the vacuum roll 60 so that its adhesive side faces radially outwardly. The tape is held on the periphery of the vacuum roll 60 by the action of the vacuum within the roll.

Following conventional practices, the vacuum roll to is spaced above the cutting edge 46 and disposed so that the tape 69 will be applied to both the leading end 116 and the trailing end, indicated at 120 in FIG. 9, of the expiring web during the splicing operation. A tape, like tape 69, will be placed on the other vacuum roll 58 during the next splicing operation when the web roll 32 is the expiring roll.

The operator would then check to be sure that the assembly 84 is in its first position, that is, the position shown in FIG. 4. Normally the assembly 84 would be in that first position since the assemblies 82 and 84 are alternatively used to trim the leading ends of the new web rolls which are, in turn, alternatively mounted on the spindles 33 and 34. Thus during the previous splicing operation, the assembly 84 would have been manually used to trim the leading end of the then new web roll 30 and to do this, was moved from its second to its first position as described above with respect to assembly 82.

After these preparatory steps have been taken, the web on the expiring web roll 30 can be permitted to continue to run until the expiring web roll is about exhausted. The operator must then make a decision. He can leave the web roll 30 completely expire so that trailing end 120 comes off the spool on the spindle 33. When this happens, the loss of tension in the web causes the drop roll 112 to actuate, by reason of its downward movement, its associated valve 113. This causes a brake to be applied to the spindles 33 and 34; the actuation of the power cylinder 52 which applies the nip roll 48 associated with the assembly 84, and then the actuation of the power cylinder 88 of the assembly 84, as well as the power cylinders 64 and 76. Alternatively, the operator may decide to initiate the splice before all the web has been unwound from the expiring web roll 30. In this instance, he manually actuates the switch by depressing the lever 122 as shown in FIG. 2.

Actuation of the power cylinders 64 and 76 causes the vacuum roll 60 to be moved to its second position, as shown in FIG. 10, and the trimmer heads 74 to be moved to their second positions adjacent to the side edges of the web.

The initial movement of drop roller 112 causes valve 113 to shift, which as noted actuates the power cylinders 52 for the associated nip roll 48 (that is, the nip roll on the left in FIGS. 6–9). This nip roll is then pivoted about its bearings 50 to its second position which in turn stops and holds the adjacent portion of the expiring web against the left side of the anvil 44, as best seen in FIG. 9. Actuation of the cylinder 88 of the assembly 84 causes its knife wheel assembly 90 to be rapidly moved from its first position to its second position. Movement of the assembly 90 causes the rotary edge 94 to trim or cut the adjacent portion of the expiring web along the cutting edge 46 of the anvil 44. Simultaneous with the trimming, the roller 92 presses this now cut, downstream trailing end 120, against the portion of the adhesive tape 118 that projects downstream from the cutting edge 46 and the leading end 116 of the web. As a result, the tape 118 joins the abutting ends 116 and 120, and thus, the expiring and new webs. Because both of the ends 116 and 120 have been trimmed or cut along the same cutting edge 46, there is no overlap, and the ends closely abut one another to form a good quality splice.

As the knife wheel assembly 90 of the assembly 84 nears its second position, the pin 108, which it carries, trips the whisker valve 106. Actuation of the whisker valve 106 results in the sequential actuation of power cylinders 64 and 76 and retraction of both nip rolls 48 away from both sides of the anvil 44 so that the newly spliced web may again run through the apparatus 20, the festoon assembly 40 and the press as shown in FIG. 10. As noted previously, the actual splicing, resulting from the movement of the assembly 84, occurs so quickly that the festoon assembly 40 can feed out web during this movement of assembly 84 whereby the web W never stops running through the press.

As the joined ends 116 and 120 pass through the nip between the vacuum rolls 58 and 60, the tape 70 on the vacuum roll 60 is applied to the side of the spliced ends, opposite the side to which the tape 118 was applied as best seen in FIG. 10. As applied, the tape 70 is aligned with the tape 118. The completed splice is indicated generally at 124 in FIGS. 1 and 2.

The trimmer heads 74 then trim any portion of the tapes that may project beyond the side edges of the spliced web as it now begins to run from the apparatus 22 to the festoon assembly 40. After a suitable time delay, the power cylinders 64 and 76 return the vacuum roller 60 and trimmer heads 74 to their first positions.

The preferred embodiment of the present invention has now been described. This preferred embodiment constitutes the best mode contemplated by the inventors for carrying out their invention. Because their invention may be copied without copying the precise details of the preferred embodiment, the following claims particularly point out and distinctly claim the subject matter which the inventors regard as their invention and wish to protect:

What is claimed:

1. An improved method for forming a butt splice to join together a web from a new roll of material to a web which is from an expiring roll of material, has two, substantially parallel side edges, and is being run, downstream from the expiring roll, under tension along a predetermined path of travel that includes running web storage means, the improved method comprising the steps of:

holding a portion of the web from the new roll against anvil means that includes a cutting edge;

trimming the portion of the web from the new roll along the cutting edge of the anvil means so that the trimmed edge of the downstream, leading end of the web from the new roll is aligned with and conforms to the cutting edge of the anvil means;

applying a first piece of adhesive tape to the leading end of the web from the new roll so that the adhesive of the tape faces the path of travel and so that a portion of the adhesive tape extends downstream beyond the cutting edge of the anvil means and the trimmed edge of the web from the new roll;

momentarily stopping the running of the portion of the web from the expiring roll, adjacent to the anvil means, while permitting further downstream portions of the web from the expiring roll, remote from the anvil means, to continue to run with tension;

holding the stopped, anvil means adjacent portion of the web from the expiring roll against the anvil;

trimming the stopped, anvil means adjacent portion of the web from the expiring roll along the cutting edge of the anvil means by cutting the stopped, anvil means adjacent portion of the web from the expiring roll a part at a time, across the web and beginning at one side edge thereof, so that the point of cutting moves across the stopped, anvil means adjacent portion of the web from the expiring roll from the one side edge to the other side edge, so that the uncut part of the stopped, anvil means adjacent portion of the web from the expiring roll remains under tension ahead of the point of cutting, and so that the trimmed edge of the trailing end of the stopped, anvil means adjacent portion of the web from the expiring roll is aligned with and conforms to the cutting edge of the anvil means;

adhering the cut part of the trailing end of the stopped, anvil means adjacent portion of the web from the expiring roll, behind the point of cutting, to the downstream extending portion of the adhesive tape substantially simultaneously as the point of cutting moves across the stopped, anvil means adjacent portion of the web from the expiring roll, so that the trimmed edge of the trailing end of the stopped, anvil means adjacent portion of the web from the expired roll abuts and is disposed closely adjacent to the trimmed edge of the leading edge of the web from the new roll, and so that the adhesive tape secures together the leading end of the web from the new roll and the trailing end of the web from the expiring roll; and permitting the joined web from the expiring roll and from the new roll to run again, along the path of travel, with the further downstream portions of the web from the expiring roll.

2. The improved method of claim 1 wherein the anvil means is disposed adjacent to the path of travel; wherein the portion of the web from the new roll is held against one side of the anvil means; wherein the stopped, anvil means adjacent portion of the web from the expiring web is held against another side of the anvil means; and wherein the adhesive tape faces the anvil means, when applied to the leading end of the web from the new roll; and including the further steps of: applying the adhesive tape from one side edge to the other side edge of the leading end of the web from the new roll; and supporting the portion of the adhesive tape that extends downstream beyond the cutting edge of the anvil means and the leading end of the web of the new roll while the trailing end of the stopped, anvil means adjacent portion of the web from the expiring roll is being trimmed and while the cut part of the trailing end of the stopped, anvil means adjacent portion of the web from the expiring roll is being adhered to the portion of the adhesive tape.

3. The improved method of claim 2 including the further step of trimming any tape that projects beyond the side edges of the joined web after trailing edge of the cut part of the web from the expiring roll is adhered to the portion of the adhesive tape.

4. The improved method of claim 2 including the further step of applying a second piece of adhesive tape to the joined leading edge of the web of the new roll and the trailing end of the web from the expiring roll, with the adhesive of the second piece of tape facing toward the adhesive of the first piece of tape, after the joined web from the expiring roll and the new roll have commenced to run again.

5. The improved method of claim 4 including the further step of trimming any tape that projects beyond the side edges of the joined web after the other piece of adhesive tape has been applied to the joined web.

6. An improved apparatus for forming a butt splice to join together a web from a new roll of material to a web which is from an expiring roll of material, has two substantially parallel side edges, and is being run, downstream from the expiring roll, under tension along a predetermined path of travel that includes running web storage means, the improved apparatus comprising:

an anvil disposed adjacent to the path of travel and having first and second sides and a cutting edge at the downstream ends of the sides;

means for supporting the expiring roll and the new roll so that each web on each roll may run off of the roll and past the anvil;

means for selectively holding a portion of the web from the new roll against the first side of the anvil;

means for selectively trimming off the web from the new roll along the cutting edge of the anvil so that the trimmed edge of the leading end of the web from the new roll is aligned with and conforms to the cutting edge of the anvil and so that a first piece of adhesive tape can be applied to one side of the leading end, with the adhesive on the adhesive tape facing the path of travel and with an exposed portion of the adhesive tape projecting downstream beyond the cutting edge of the anvil and the trimmed edge of the web from the new roll;

means for momentarily stopping the running of the portion of the web from the expiring roll adjacent to the anvil while permitting the further downstream portions of the web from the expiring roll, remote from the anvil, to continue to run under tension;

means for selectively holding the stopped, anvil adjacent portion of the web from the expiring roll against the second side of the anvil;

means for trimming the stopped, anvil adjacent portion of the web from the expiring roll along the cutting edge of the anvil by cutting the stopped, anvil adjacent portion of the web from the expiring roll a part at a time, across the web and beginning at one side edge thereof, so that the point of cutting moves across the stopped, anvil adjacent portion of the web from the expiring roll from the one side edge to the other side edge, so that the uncut part of the web from the expiring roll remains under tension ahead of the point of cutting, and so that the trimmed edge of the trailing end of the stopped, anvil adjacent portion of the web from the expiring roll is aligned with an conforms to the cutting edge of the anvil; means for applying the cut part of the trailing end of the stopped, anvil adjacent portion of the web from the expiring roll, behind the point of cutting, to the downstream extending, exposed portion of the adhesive tape substantially simultaneously as the point of cutting moves across the stopped, anvil adjacent portion of the web from the expiring roll so that the trimmed edge of the trailing end of the stopped, anvil adjacent portion of the web from the expiring roll abuts and is disposed closely adjacent to the trimmed edge of the leading end of the web from the new roll, and so that the adhesive tape secures together the leading end of the web from the new roll and the trailing end of the web from the expiring roll; and means for permitting the joined leading end of the web from the new roll and the trailing end of the web of the expiring roll to run again, along the path of travel, with the further downstream portions of the web of the expiring roll.

7. The improved apparatus of claim 6 which includes means for supporting the portion of the adhesive tape and the leading end of the web from the new roll while the stopped, anvil adjacent portion of the web is trimmed and while the trailing end of the stopped, anvil adjacent portion of the web from the expiring roll is adhered to the portion of the adhesive tape; and wherein the cutting edge of the anvil is disposed at an acute angle with respect to the path of travel.

8. The improved apparatus of claim 7 which includes means for applying a second piece of adhesive tape to the other sides of the joined leading end of the web from the new roll and the trailing end of the web from the expiring roll after the joined ends have been permitted to run again.

9. The improved apparatus of claim 8 which includes means for trimming any tape that projects beyond the side edges of the joined web after the second piece of tape has been applied to the joined web.

10. The improved apparatus of claim 7 wherein the means for adhering the cut part of the trailing end of the stopped, anvil adjacent portion of the web from the expiring roll includes a roller whose axis of rotation is substantially parallel to the path of travel adjacent to the anvil, with the roller being disposed immediately downstream from the cutting edge of the anvil, adjacent to the second side of the anvil, and having a peripheral surface that, when in contact with the trailing end of the stopped, anvil adjacent portion of the web from the expiring roll, projects beyond the plane of the second side of the anvil toward the plane of the first side of the anvil, and with the roller also being movable across the anvil, adjacent to the cutting edge, from one side edge of the web from the expiring roll to the other.

11. The improved apparatus of claim 10 wherein the means for trimming the stopped, anvil adjacent portion of the web from the expiring roll moves with the roller and includes a circular knife blade on the upstream end of the roller and adjacent to the cutting edge of the anvil.

12. The improved apparatus of claim 6 which includes means for trimming any tape that projects beyond the side edges of the joined web after the trailing edge of the cut part of the web from the expiring roll is adhered to the portion of the adhesive tape.

* * * * *